US005378388A

United States Patent [19]

Pancheri

[11] Patent Number: 5,378,388

[45] Date of Patent: Jan. 3, 1995

[54] GRANULAR DETERGENT COMPOSITIONS CONTAINING SELECTED BUILDERS IN OPTIMUM RATIOS

[75] Inventor: Eugene J. Pancheri, Montgomery, Ohio

[73] Assignee: The Procter & Gamble Company, Cincinnati, Ohio

[21] Appl. No.: 82,628

[22] Filed: Jun. 25, 1993

[51] Int. Cl.[6] ..... C11D 3/12; C11D 1/08; C11D 3/08

[52] U.S. Cl. ..... 252/174.25; 252/135; 252/174.19; 252/DIG. 11

[58] Field of Search ..... 252/174.25, 174.19, 252/135, DIG. 11

[56] References Cited

U.S. PATENT DOCUMENTS

| | | | |
|---|---|---|---|
| 3,985,669 | 10/1976 | Krummel et al. | 252/116 |
| 4,414,130 | 11/1983 | Cheng | 252/140 |
| 4,605,509 | 8/1986 | Corkill et al. | 252/131 |
| 4,631,158 | 12/1986 | Rieck et al. | 264/43 |
| 4,664,839 | 5/1987 | Rieck | 252/175 |
| 4,737,306 | 4/1988 | Wichelhaus et al. | 252/95 |
| 4,810,413 | 3/1989 | Pancheri et al. | 252/174.12 |
| 4,820,439 | 4/1989 | Rieck | 252/135 |
| 4,861,503 | 8/1989 | Hollingsworth et al. | 252/135 |
| 4,923,631 | 5/1990 | Sims et al. | 252/186.42 |
| 4,963,158 | 10/1990 | Beaujean et al. | 8/137 |
| 5,078,895 | 1/1992 | Dany et al. | 252/94 |
| 5,108,646 | 4/1992 | Beerse et al. | 252/174.25 |
| 5,126,418 | 6/1992 | Porz et al. | 526/234 |
| 5,135,675 | 8/1992 | Elliott et al. | 252/103 |
| 5,165,915 | 11/1992 | Tokubo et al. | 424/63 |
| 5,180,515 | 1/1993 | Boucher et al. | 252/135 |

FOREIGN PATENT DOCUMENTS

| | | |
|---|---|---|
| 0405122 | 1/1991 | European Pat. Off. . |
| 0234878 | 4/1986 | Germany . |
| 1153800 | 6/1989 | Japan . |
| 9203525 | 3/1992 | WIPO . |

*Primary Examiner*—Paul Lieberman
*Assistant Examiner*—A. Hertzog
*Attorney, Agent, or Firm*—Ken K. Patel; Jacobus C. Rasser; Jerry J. Yetter

[57] ABSTRACT

A granular detergent composition having improved cleaning performance is provided. The detergent composition contains a detergent surfactant selected from the group consisting of anionics, nonionics, zwitterionics, ampholytics, cationics and mixtures thereof, and a mixture of non-phosphate detergent builders. The builder mixture comprises an aluminosilicate ion exchange material, crystalline layered sodium silicate and citrate/citric acid in an optimum ratio of from about 3.5:1:1 to about 4.5:1:1.

9 Claims, No Drawings

GRANULAR DETERGENT COMPOSITIONS CONTAINING SELECTED BUILDERS IN OPTIMUM RATIOS

FIELD OF THE INVENTION

The present invention generally relates to detergent compositions exhibiting superior cleaning performance. More particularly, the invention is directed to granular detergent compositions containing selected builders which are in optimum ratios, all of which provide surprisingly improved performance over detergents used in the past. The selected builders incorporated in the detergent compositions include aluminosilicate, crystalline layered silicates and citrate/citric acid in specific ratios which are defined hereinafter.

BACKGROUND OF THE INVENTION

As is well known, naturally occurring water including surface water, ground water and conventional untreated tap water typically contains a number of salts which are dissolved out of the soil and rock. The most important constituents are the salts of sodium, calcium and magnesium. Of these, only alkaline earth metals such as calcium and magnesium are responsible for this so-called "hardness" in the water. This hardness presents problems during typical washing processes since the alkaline earth metal ions impair the washing effectiveness of the surfactants contained in conventional detergents. For this reason, builders are added to detergents so that the interaction between the metal ions and the surfactants is completely or partly avoided, thereby increasing the washing effectiveness of the surfactants. In this way, the metal ions and builders are converted to water soluble/dispersable complexes. It is preferable to avoid formation of complexes which can precipitate from the washing solution as they can deposit of the fabrics.

There have been a wide variety of builders used in detergent compositions for purposes of increasing the effectiveness of surfactants in detergents by softening, i.e. removing the hardness from washing solutions. For example, phosphate-based builders such as pentasodium triphosphate have been found to be effective in detergent formulations. The phosphate-based builders, however, have been held responsible for eutrophication of rivers and lakes, i.e. increasing the algae growth and oxygen consumption. Accordingly, measures have been taken to limit the content of phosphates in detergents.

Materials such as zeolites have been used as a substitute for phosphate builders. The zeolites are capable of the calcium ion content by ion exchange. The magnesium binding capacity, however, is very low. Thus, the use of zeolite alone in detergents has not resulted in satisfactory cleaning performance.

Further, sodium silicates have been used, as well. The chief function of these builders is to provide a supply of sodium ions and increase the pH value of the washing solutions. The use of only the amorphous version of such sodium silicates has not provided the superior cleaning now required by the industry.

Rieck, U.S. Pat. No. 4,820,439 (Hoechst), discloses the use of crystalline layered sodium silicates as detergent builders which soften water containing calcium and magnesium ions. The calcium and magnesium ion binding capacity of crystalline layered sodium silicates is indicated as being superior to amorphous sodium silicates. Rieck suggest the composition of the crystalline layered sodium silicates to have the formula $NaMSi_xO_{2x+1}.yH_2O$ wherein M denotes sodium or hydrogen, x is from 1.9 to 4 and y is from 0 to 20. While the Rieck sodium silicates provides improved softening over amorphous sodium silicates, there is a continuing need for a combination of builders which can provide the performance required by detergent formulations.

Beerse et al, U.S. Pat. No. 5,108,646 (Procter & Gamble), disclose a process for agglomerating aluminosilicate or crystalline sodium silicate builders for use in detergent compositions. While Beerse et al provide builder agglomerates having satisfactory performance, they do not provide a detergent composition having a specific combination of builders which achieves superior cleaning performance.

Accordingly, despite the aforementioned disclosures in the art, there is a continuing need for a detergent composition having improved cleaning performance. Further, there is a need in the art for such a detergent composition which includes selected builders in an optimum ratio and achieves superior cleaning performance.

SUMMARY OF THE INVENTION

The present invention meets the aforementioned needs in the art by providing a detergent composition which includes at least one surfactant and a mixture of selected builders in an optimum ratio. As a consequence of the inclusion of the selected builders in an optimum ratio, the detergent composition provides improved cleaning performance. The detergent composition of the invention can also include other ingredients which are typically included in granular detergents. As used herein, the term "citrate/citric acid" refers to citric acid in addition to stoichiometric equivalent amounts of salts of citric acid such as sodium citrate and the like. All proportions and percentages used herein are expressed as percentages by weight unless specified otherwise.

In accordance with one aspect of the invention, a detergent composition with the previously mentioned improved cleaning performance is provided. A granular detergent composition comprising: (a) from about 5% to about 95% by weight of a detergent surfactant selected from the group consisting of anionics, nonionics, zwitterionics, ampholytics, cationics and mixtures thereof; and (b) from about 5% to about 95% by weight of a mixture of non-phosphate detergent builders. The builder mixture comprises an aluminosilicate ion exchange material, crystalline layered sodium silicate and citrate/citric acid in a ratio of from about 3.5:1:1 to about 6:1:1. The detergent composition may also include from about 5% to bout 90% by weight of additional ingredients selected from the group consisting of water-soluble salt, suds control agent, soil suspending agent, soil release agent, pH adjusting agent, chelating agent, smectite clay, enzymes, enzyme-stabilizing agents, perfumes and fluorescent brighteners.

Accordingly, it is an object of the present invention to provide a detergent composition which achieves improved cleaning performance by including selected builders in an optimum ratio. These and other objects, features and attendant advantages of the present invention will become apparent to those skilled in the art from a reading of the following detailed description of the preferred embodiment and the appended claims.

DETAILED DESCRIPTION OF THE PREFERRED EMBODIMENT

The present invention is directed to an improved granular detergent composition comprising a mixture of selected non-phosphate builders which, when included in specific ratios, surprisingly provide superior cleaning performance. All of the cleaning benefits are achieved without sacrificing the physical properties of the granular detergent composition. In addition to a surfactant or mixture thereof, the detergent composition can contain those ingredients typically incorporated into granular detergents, several of which are preferred as described hereinafter.

In a preferred embodiment, the granular detergent composition comprises: (a) from about 5% to about 95% by weight of a detergent surfactant selected from the group consisting of anionics, nonionics, zwitterionics, ampholytics, cationics and mixtures thereof; and (b) from about 5% to about 95% by weight of a mixture of non-phosphate detergent builders. The builder mixture comprises an aluminosilicate ion exchange material, crystalline layered sodium silicate and citrate/citric acid in a ratio of from about 3.5:1:1 to about 6:1:1. Most preferably, the builder mixture comprises an aluminosilicate ion exchange material, crystalline layered sodium silicate and citrate/citric acid in a ratio of 4.5:1:1.

Additional preferred detergent compositions include those having crystalline layered sodium silicate and citrate/citric acid in a ratio of from about 0.5:1 to about 2:1, most preferably from about 0.65:1 to about 1.55:1. In another preferred embodiment, the ratio of aluminosilicate ion exchange material and citrate/citric acid is in a ratio of from about 1.5:1 to about 6:1. Within these optimum builder ratios, the detergent composition of the invention achieves improved cleaning performance.

The Selected Builders

Although the art is replete with detergent builders which improve the performance of laundry detergents and the like, the detergent composition of the present invention selectively includes aluminosilicate ion exchange material, crystalline layered sodium silicate and citrate/citric acid in specific optimum ratios. It should be understood, however, that additional builders may be included in the detergent composition without departing from the scope of the invention.

A. Aluminosilicate

The aluminosilicate ion exchange materials used herein as a detergent builder preferably have both a high calcium ion exchange capacity and a high exchange rate. Without intending to be limited by theory, it is believed that such high calcium ion exchange rate and capacity are a function of several interrelated factors which derive from the method by which the aluminosilicate ion exchange material is produced. In that regard, the aluminosilicate ion exchange materials used herein are preferably produced in accordance with Corkill et al, U.S. Pat. No. 4,605,509 (Procter & Gamble), the disclosure of which is incorporated herein by reference.

Preferably, the aluminosilicate ion exchange material is in "sodium" form since the potassium and hydrogen forms of the instant aluminosilicate do not exhibit the as high of an exchange rate and capacity as provided by the sodium form. Additionally, the aluminosilicate ion exchange material preferably is in hydrated form. In that regard, the aluminosilicate contains from about 10% to about 40%, more preferably from about 12% to about 30% by weight water. Most preferably, the instant aluminosilicate contains from about 15% to about 28% by weight water. It has been found that less highly hydrated aluminosilicates, for example those containing 6% by weight water or less, do not function as effectively as ion exchange builders when employed in the context of a laundry detergent.

The aluminosilicate ion exchange materials used herein preferably have particle size diameters which optimize their effectiveness as detergent builders. The term "particle size diameter" as used herein represents the average particle size diameter of a given aluminosilicate ion exchange material as determined by conventional analytical techniques, such as microscopic determination and scanning electron microscope (SEM). The preferred particle size diameter of the aluminosilicate is from about 0.1 micron to about 10 microns, more preferably from about 0.5 microns to about 9 microns. Most preferably, the particle size diameter is from about 1 microns to about 8 microns.

Preferably, the aluminosilicate ion exchange material has the formula $$Na_z[(AlO_2)_z \cdot (SiO_2)_y]xH_2O$$

wherein z and y are integers of at least 6, the molar ratio of z to y is from about 1 to about 5 and x is from about 10 to about 264. More preferably,the aluminosilicate has the formula $$Na_{12}[(AlO_2)_{12} \cdot (SiO_2)_{12}]xH_2O$$

wherein x is from about 20 to about 30, preferably about 27. These preferred aluminosilicates are available commercially, for example under designations Zeolite A, Zeolite B and Zeolite X. Alternatively, naturally-occurring or synthetically derived aluminosilicate ion exchange materials suitable for use herein can be made as described in Krummel et al, U.S. Pat. No. 3,985,669, the disclosure of which is incorporated herein by reference.

Although completely hydrated aluminosilicate ion exchange materials are preferred herein, it is recognized that the partially dehydrated aluminosilicates having the formula presented previously are also very suitable for rapidly and effectively reducing the water hardness during the laundering operation. Of course, in the process of preparing the aluminosilicates used herein, reaction-crystallization parameter fluctuations can result in such partially hydrated materials.

The aluminosilicates used herein are further characterized by their ion exchange capacity which is at least about 200 mg equivalent of $CaCO_3$ hardness/gram, calculated on an anhydrous basis, and which is preferably in a range from about 300 to 352 mg equivalent of $CaCO_3$ hardness/gram. Additionally, the instant aluminosilicate ion exchange materials are still further characterized by their calcium ion exchange rate which is at least about 2 grains $Ca^{++}$/gallon/minute/-gram/gallon, and more preferably in a range from about 2 grains $Ca^{++}$/gallon/minute/-gram/gallon to about 6 grains $Ca^{++}$/gallon/minute/-gram/gallon.

B. Crystalline Layered Sodium Silicate

In comparison with amorphous sodium silicates, crystalline layered sodium silicates exhibit a clearly increased calcium and magnesium ion exchange capacity. In addition, the layered sodium silicates prefer magnesium ions over calcium ions, a feature necessary to insure that substantially all of the "hardness" is removed from the wash water. These crystalline layered sodium silicates, however, are generally more expensive than amorphous silicates as well as other builders. Accordingly, in order to provide an economically feasible laundry detergent, the proportion of crystalline layered sodium silicates used must be determined judiciously. To that end, the instant invention strikes a balance between cost and ion exchange performance by providing an optimum builder ratio which is effective against both calcium and magnesium ions and which, thereby results in improved cleaning performance of the ultimate laundry detergent into which the builders are incorporated.

The crystalline layered sodium silicates suitable for use herein preferably have the formula $$NaMSi_xO_{2x+1}.yH_2O$$

wherein M is sodium or hydrogen, x is from about 1.9 to about 4 and y is from about 0 to about 20. More preferably, the crystalline layered sodium silicate has the formula $$NaMSi_2O_5.yH_2O$$

where M is sodium or hydrogen, and y is from about 0 to 20. These and other crystalline layered sodium silicates are discussed in Rieck, U.S. Pat. No. 4,820,439, the disclosure of which is incorporated herein by reference.

The crystalline layered sodium silicate preferably has an average particle size diameter of from about 0.01 microns to about 1000 microns, most preferably from about 0.1 microns to about 10 microns. The term "particle size diameter" as used herein represents the average particle size diameter of a given ion exchange material as determined by conventional analytical techniques such as a scanning electron microscope (SEM).

C. Citrate/citric acid

Another essential builder component for the granular detergent composition of the invention is citrate/citric acid including citric acid, salts thereof and mixtures of the two. The preferred citric acid salt is sodium citrate. As those skilled in the art will appreciate, such builder materials are widely available from numerous commercial sources. For example, suitable citrate/citric acid may be purchased from Haarman & Reimer Corporation. Alternatively, citrate/citric acid can be readily synthesized by well-known reaction mechanisms.

Other builder materials similar to citrate/citric acid which are suitable for use in place of citrate/citric acid are selected from the group consisting of succinate tartrates, carboxymethoxysuccinic acid, oxydisuccinic acid and salts thereof. As those skilled in the art will appreciate, additional materials similar in nature to those described herein may be used without departing from the scope of the invention.

Detergent Surfactant

The improved granular detergent composition of the inventions preferably includes a surfactant at a level of from about 5% to about 95% by weight, more preferably about 10% to about 50% by weight. Preferably, the detergent surfactant is selected from the group consisting of anionics, nonionics, zwitterionics, ampholytics, cationics, and mixtures thereof.

Water-soluble salts of the higher fatty acids, i.e., "soaps", are useful anionic surfactants in the compositions herein. This includes alkali metal soaps such as the sodium, potassium, ammonium, and alkylolammonium salts of higher fatty acids containing from about 8 to about 24 carbon atoms, and preferably from about 12 to about 18 carbon atoms. Soaps can be made by direct saponification of fats and oils or by the neutralization of free fatty acids. Particularly useful are the sodium and potassium salts of the mixtures of fatty acids derive from coconut oil and tallow, i.e., sodium or potassium tallow and coconut soap.

Useful anionic surfactants also include the water-soluble salts, preferably the alkali metal, ammonium and alkylolammonium salts, of organic sulfuric reaction products having in their molecular structure an alkyl group containing from about 10 to about 20 carbon atoms and a sulfonic acid or sulfuric acid ester group. (Included in the term "alkyl" is the alkyl portion of acyl groups). Examples of this group of synthetic surfactants are the sodium and potassium alkyl sulfates, especially those obtained by sulfating the higher alcohols ($C_{12}$–$C_{18}$ carbon atoms) such as those produced by reducing the glycerides of tallow or coconut oil; and the sodium and potassium alkylbenzene sulfonates in which the alkyl group contains from about 10 to about 16 carbon atoms, in straight chain or branched chain configuration, e.g., see U.S. Pat. Nos. 2,220,099 and 2,477,383. Especially valuable are linear straight chain alkylbenzene sulfonates in which the average number of carbon atoms in the alkyl group is from about 11 to 14, abbreviated as $C_{11-14}$ LAS. Especially preferred is from about 12 to 20 weight % of a mixture of $C_{10-16}$ linear alkylbenzene sulfonate and $C_{12-18}$ alkyl sulfate. These are preferably in a weight ratio of between about 20:80 and 80:20, most preferably between about 30:70 and 70:30, sodium $C_{10-16}$ (preferably $C_{11-14}$) LAS:sodium $C_{12-18}$ (preferably $C_{14-16}$) alkyl sulfate.

Other anionic surfactants herein are the sodium alkyl glyceryl ether sulfonates, especially those ethers of higher alcohols derived from tallow and coconut oil; sodium coconut oil fatty acid monoglyceride sulfonates and sulfates; sodium or potassium salts of alkyl phenol ethylene oxide ether sulfates containing from about 1 to about 10 units of ethylene oxide per molecule and wherein the alkyl groups contain from about 8 to 12 carbon atoms; and sodium or potassium salts of alkyl ethylene oxide ether sulfates containing about 1 to about 10 units of ethylene oxide per molecule and wherein the alkyl group contains from about 10 to about 20 carbon atoms. Also, $C_{14-18}$ secondary alcohol sulfates can be conveniently employed herein.

Still other useful anionic surfactants suitable for use herein include the water-soluble salts of esters of alpha-sulfonated fatty acids containing from about 6 to 20 carbon atoms in the fatty acid group and from about 1 to 10 carbon atoms in the ester group; water-soluble salts of 2-acyloxyalkane-1-sulfonic acids containing from about 2 to 9 carbon atoms in the acyl group and from about 9 to about 23 carbon atoms in the alkane moiety; water-soluble salts of olefin and paraffin sulfonates containing from about 12 to 20 carbon atoms; and beta-alkyloxy alkane sulfonates containing from about 1 to 3 carbon atoms in the alkyl group and from about 8 to 20 carbon atoms in the alkane moiety.

Water-soluble nonionic surfactants are also useful in the instant detergent granules. Such nonionic materials include compounds produced by the condensation of alkylene oxide groups (hydrophilic in nature) with an organic hydrophobic compound, which may be aliphatic or alkyl aromatic in nature. The length of the polyoxyalkylene group which is condensed with any particular hydrophobic group can be readily adjusted to yield a water-soluble compound having the desired degree of balance between hydrophilic and hydrophobic elements. Suitable nonionic surfactants include the polyethylene oxide condensates of alkyl phenols, e.g., the condensation products of alkyl phenols having an alkyl group containing from about 6 to 15 carbon atoms, in either a straight chain or branched chain configuration, with from about 3 to 80 moles of ethylene oxide per mole of alkyl phenol. Included are the water-soluble and water-dispersible condensation products of aliphatic alcohols containing from 8 to 22 carbon atoms, in either straight chain or branched configuration, with from 3 to 12 moles of ethylene oxide per mole of alcohol.

Still other nonionic surfactants suitable for use herein are semi-polar nonionic surfactants which include water-soluble amine oxides containing one alkyl moiety of from abut 10 to 18 carbon atoms and two moieties selected from the group of alkyl and hydroxyalkyl moieties of from about 1 to about 3 carbon atoms; water-soluble phosphine oxides containing one alkyl moiety of about 10 to 18 carbon atoms and two moieties selected from the group consisting of alkyl groups and hydroxyalkyl groups containing from about 1 to 3 carbon atoms; and water-soluble sulfoxides containing one alkyl moiety of from about 10 to 18 carbon atoms and a moiety selected from the group consisting of alkyl and hydroxyalkyl moieties of from about 1 to 3 carbon atoms.

Additional suitable nonionic surfactants include polyhydroxy fatty acid amides of the formula

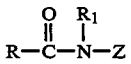

wherein R is a $C_{9-17}$ alkyl or alkenyl, $R_1$ is a methyl group and Z is glycityl derived from a reduced sugar or alkoxylated derivative thereof. Examples are N-methyl n-1-deoxyglucityl cocoamide and N-methyl N-1-deoxyglucityl oleamide. Processes for making polyhydroxy fatty acid amides are known and can be found in Wilson, U.S. Pat. No. 2,965,576 and Schwartz, U.S. Pat. No. 2,703,798, the disclosures of which are incorporated herein by reference.

Preferred nonionic surfactants are of the formula $R^1(OC_2H_4)_nOH$, wherein $R^1$ is a $C_{10}$–$C_{16}$ alkyl group or a $C_8$–$C_{12}$ alkyl phenyl group, and n is from 3 to about 80. Particularly preferred are condensation products of $C_{12}$–$C_{15}$ alcohols with from about 5 to about 20 moles of ethylene oxide per mole of alcohol, e.g., $C_{12}$–$C_{13}$ alcohol condensed with about 6.5 moles of ethylene oxide per mole of alcohol.

Ampholytic surfactants include derivatives of aliphatic or aliphatic derivatives of heterocyclic secondary and tertiary amines in which the aliphatic moiety can be straight chain or branched and wherein one of the aliphatic substituents contains from about 8 to 18 carbon atoms and at least one aliphatic substituent contains an anionic water-solubilizing group. Zwitterionic surfactants include derivatives of aliphatic, quaternary, ammonium, phosphonium, and sulfonium compounds in which one of the aliphatic substituents contains from about 8 to 18 carbon atoms.

Cationic surfactants can also be included in the present detergent granules. Cationic surfactants comprise a wide variety of compounds characterized by one or more organic hydrophobic groups in the cation and generally by a quaternary nitrogen associated with an acid radical. Pentavalent nitrogen ring compounds are also considered quaternary nitrogen compounds. Halides, methyl sulfate and hydroxide are suitable. Tertiary amines can have characteristics similar to cationic surfactants at washing solution pH values less than about 8.5. A more complete disclosure of these and other cationic surfactants useful herein can be found in U.S. Pat. No. 4,228,9044, Cambre, issued Oct. 14, 1980, incorporated herein by reference.

Cationic surfactants are often used in detergent compositions to provide fabric softening and/or antistatic benefits. Antistatic agents which provide some softening benefit and which are preferred herein are the quaternary ammonium salts described in U.S. Pat. No. 3,936,537, Baskerville, Jr. et al., issued Feb. 3, 1976, which is incorporated herein by reference. Useful cationic surfactants also include those described in U.S. Pat. No. 4,222,905, Cockrell, issued Sep. 16, 1980, and in U.S. Pat. No. 4,239,659, Murphy, issued Dec. 16, 1980, both incorporated herein by reference.

Optional Ingredients

Additional detergent ingredients suitable for inclusion in a granular detergent composition may be added to the instant composition. These include other detergency builders, bleaches, bleach activators, suds boosters or suds suppressors, anti-tarnish and anticorrosion agents, soil suspending agents, soil release agents, germicides, pH adjusting agents, non-builder alkalinity sources, chelating agents, smectite clays, enzymes, enzyme-stabilizing agents and perfumes. See U.S. Pat. No. 3,936,537, issued Feb. 3, 1976 to Baskerville, Jr. et al., incorporated herein by reference.

Bleaching agents and activators are described in U.S. Pat. No. 4,412,934, Chung et al., issued Nov. 1, 1983, and in U.S. Pat. No. 4,483,781, Hartman, issued Nov. 20, 1984, both of which are incorporated herein by reference. Chelating agents are also described in U.S. Pat. No. 4,663,071, Bush et al., from Column 17, line 54 through Column 18, line 68, incorporated herein by reference. Suds modifiers are also optional ingredients and are described in U.S. Pat. No. 3,933,672, issued Jan. 20, 1976 to Bartoletta et al., and U.S. Pat. No. 4,136,045, issued Jan. 23, 1979 to Gault et al., both incorporated herein by reference.

Suitable smectite clays for use herein are described in U.S. Pat. No. 4,762,645, Tucker et al, issued Aug. 9, 1988, Column 6, line 3 through 7, line 24, incorporated herein by reference. Suitable additional detergency builders for use herein are enumerated in the Baskerville patent, Column 13, line 54 through Column 16, line 16, and in U.S. Pat. No. 4,663,071, Bush et al, issued May 5, 1987, both incorporated herein by reference.

Process

The detergents of the present invention can be made by a wide variety of processes, such as by conventional spray drying techniques. In addition to spray drying, the detergents can be formulated by agglomeration or the combination of spray drying and agglomeration techniques. It is preferable, however, to add the citrate/citric acid and crystalline layered sodium silicate builders to the detergent composition after the spray drying and/or agglomeration process. Such processes for forming detergent granules and/or agglomerates is well known in the art.

The present invention also provides a method of laundering soiled clothes. Specifically, soiled clothes are contacted with an effective amount of the granular detergent compositions described herein in the presence of water, i.e., aqueous media. While the amount of detergent can vary widely depending upon the particular application, typical amounts are on the order of from about 1000 ppm to about 1500 ppm. In order to make the present invention more readily understood, reference is made to the following examples, which are intended to be illustrative only and not intended to be limiting in scope.

EXAMPLE I

This example illustrates several granular detergent compositions (compositions B, C, and D) which are made in accordance with the invention by a conventional spray drying process. Table I also presents composition A which has a builder system outside of the scope of the invention. The various components of compositions A, B, C and D are expressed in percentages by weight

TABLE I

| Component | Compositions (% weight) A | B | C | D |
|---|---|---|---|---|
| $C_{14-15}$ alkyl sulfate | 13 | 13 | 13 | 13 |
| $C_{12-13}$ ethoxylated sulfate (EO3) | 4.3 | 4.3 | 4.3 | 4.3 |
| $C_{12-14}$ N-methylglucamide | 4.3 | 4.3 | 4.3 | 4.3 |
| $C_{9-11}$ ethoxylated sulfate (EO10) | 1.4 | 1.4 | 1.4 | 1.4 |
| Sodium polyacrylate | 3.2 | 3.2 | 3.2 | 3.2 |
| Protease enzyme | 0.8 | 0.8 | 0.8 | 0.8 |
| Polyethylene glycol (M.W. 4000) | 1.8 | 1.8 | 1.8 | 1.8 |
| Aluminosilicate | 34.3 | 28.6 | 29.8 | 25.5 |
| Crystalline layered sodium silicate[1] | 8 | 7.1 | 5.9 | 10.2 |
| Citric Acid | — | 7.1 | 7.1 | 7.1 |
| Sodium carbonate | 28.6 | 28.6 | 28.6 | 28.6 |

[1]SKS6 commericially available from Hoechst Aktiengesellschaft

For purposes of demonstrating the improved cleaning performance obtained with detergent compositions of the invention, compositions A, B, C and D in Table I are used to wash soiled items with water having a hardness level of about 12 grains/gallon in conventional full-scale laundry washing machines with 12 minute wash cycles, after which the items are dried for 50 minutes in conventional dryers. Panelists are asked to compare the clothes washed with detergents described herein with the those clothes washed with detergents outside the scope of the invention and assign grades according to the following scale:

0=no difference between two samples
1=think there is a difference
2=know there is a little difference
3=know there is a lot of difference
4=know there is a whole lot of difference Each panelist grades the samples under standard lighting. Table II provides the results for compositions A, B, C, D. Composition A is normalized to a PSU score of "1" so as to provide a framework for comparison of cleaning performance.

TABLE II

| | PSU A | B | C | D |
|---|---|---|---|---|
| Clay (cotton) | 1 | 2.35 | 2.46 | 2.3 |
| Clay (poly-cotton) | 1 | 2.44 | 2.22 | 2.32 |
| Grass | 1 | .66 | .21 | .25 |
| Gravy | 1 | 1.65 | 2.39 | 2.11 |
| Blood | 1 | 1.70 | 1.69 | 1.63 |
| Spaghetti Sauce | 1 | 1.25 | 1.07 | 1.21 |

TABLE II-continued

| | PSU A | B | C | D |
|---|---|---|---|---|
| Grease | 1 | 1.32 | 1.51 | 1 |

From the results shown in Table II, it is apparent that granular detergent compositions having the builder ratios described herein (compositions B, C and D) unexpectedly provide improved cleaning over composition A which is outside the scope of the invention.

EXAMPLE II

This example illustrates several additional granular detergent compositions, all of which are made according to the invention using conventional granulation processes. Table III presents compositions E, F, G and H which are within the scope of the invention. All of the components are expressed in percentages by weight.

TABLE III

| Component | Compositions (% weight) E | F | G | H |
|---|---|---|---|---|
| $C_{14-15}$ alkyl sulfate | 13.3 | 13.3 | 13.3 | 13.3 |
| $C_{12-13}$ ethoxylated sulfate (ED3) | 4.4 | 4.4 | 4.4 | 4.4 |
| $C_{12-14}$ N-methylglucamide | 4.4 | 4.4 | 4.4 | 4.4 |
| $C_{9-11}$ ethoxylated sulfate (ED10) | 1.5 | 1.5 | 1.5 | 1.5 |
| Sodium polyacrylate | 3.3 | 3.3 | 3.3 | 3.3 |
| Protease enzyme | 0.8 | 0.8 | 0.8 | 0.8 |
| Polyethylene glycol (N.W. 4000) | 1.9 | 1.9 | 1.9 | 1.9 |
| Aluminosilicate | 31.4 | 29.9 | 28.7 | 27.2 |
| Crystalline layered sodium silicate[1] | 7.8 | 7.5 | 8.5 | 10.4 |
| Citric Acid | 5.2 | 7.0 | 7.1 | 7.1 |
| Sodium carbonate | 25.9 | 25.9 | 25.9 | 25.9 |

[1]SKS6 commericially available from Hoechst Aktiengesellschaft

In order to provide the relative improved cleaning performance obtained among detergent compositions made in accordance with the invention, compositions E, F, G and H in Table III are used to wash soiled items as described in Example I. All of the compositions in Table III, namely compositions E, F, G, and H, are within the scope of the invention. Panelists are asked to compare the clothes washed with composition E with those clothes washed with compositions F, G and H and assign grades according to the scale presented in Example I.

TABLE IV

| | PSU E | F | G | H |
|---|---|---|---|---|
| Clay (cotton) | 2 | 2.01 | 2.3 | 1.90 |
| Clay (poly-cotton) | 2 | 2.07 | 2.04 | 2.67 |
| Grass | 2 | 2.5 | 2.09 | 1.66 |
| Gravy | 2 | 1.5 | 1.77 | 1.79 |
| Blood | 2 | 1.85 | 1.67 | 1.70 |
| Spaghetti Sauce | 2 | 1.92 | 1.99 | 1.64 |
| Grease | 2 | 2 | 1.96 | 1.80 |

The results in Table IV indicate that while improved cleaning performance is obtained with all of the compositions, composition E performs generally better than compositions F, G, and H.

Having thus described the invention in detail, it will be obvious to those skilled in the art that various changes may be made without departing from the scope of the invention and the invention is not to be considered limited to what is described in the specification.

What is claimed is:

1. A granular detergent composition comprising:

(a) from about 5% to about 95% by weight of a detergent surfactant selected from the group consisting of anionics, nonionics, and mixtures thereof;

(b) from about 5% to about 95% by weight of a mixture of non-phosphate detergent builders, wherein said mixture comprises an aluminosilicate ion exchange material, crystalline layered sodium silicate and citrate/citric acid in a ratio of from about 3.5:1:1 to about 6:1:1; and (c) an adjunct material selected from the group consisting of bleaches, bleach activators, suds boosters, suds suppressors, anti-tarnish and anticorrosion agents, soil suspending agents, soil release agents, germicides, pH adjusting agents, non-builder alkalinity sources, chelating agents, smectite clays, enzymes, enzyme-stabilizing agents, perfumes and mixtures thereof.

2. The detergent composition of claim 1 wherein said ratio is from about 3.5:1:1 to about 4.5:1:1.

3. The detergent composition of claim 1 wherein said aluminosilicate ion exchange material has the formula $$Na_z[(AlO_2)_z.(SiO_2)_y]xH_2O$$

wherein z and y are integers of at least 6, the molar ratio of z to y is from about 1 to about 5 and x is from about 10 to about 264.

4. The detergent composition of claim 3 wherein said aluminosilicate ion exchange material has a particle size of from about 0.1 microns to about 10 microns, a calcium ion exchange capacity of at least about 200 mg equivalent of $CaCO_3$ hardness/gram, and a calcium ion exchange rate of at least about 2 grains $Ca^{++}$/gallon/-minute/-gram/gallon.

5. The detergent composition of claim 3 wherein said aluminosilicate ion exchange material has a particle size of from about 0.1 microns to about 10 microns, a calcium ion exchange capacity in a range from about 300 to 352 mg equivalent of $CaCO_3$ hardness/gram, and a calcium ion exchange rate in a range from about 2 grains $Ca^{++}$/gallon/minute/-gram/gallon to about 6 grains $Ca^{++}$/gallon/minute/-gram/gallon.

6. The detergent composition of claim 1 wherein said aluminosilicate ion exchange material has the formula $$Na_{12}[(AlO_2)_{12}.(SiO_2)_{12}]xH_2O$$

wherein x is about 27.

7. The detergent composition of claim 1 wherein said crystalline layered sodium silicate has the formula $$NaMSi_xO_{2x+1}.yH_2O$$

wherein M is sodium or hydrogen, x is from about 1.9 to about 4 and y is from about 0 to about 20.

8. The detergent composition of claim 1 wherein said ratio is about 4.5:1:1.

9. A method of laundering soiled clothes comprising the steps of contacting said clothes with an effective amount of a granular detergent composition according to claim 1 in an aqueous media.

* * * * *